US010161244B2

(12) United States Patent
Taylor et al.

(10) Patent No.: US 10,161,244 B2
(45) Date of Patent: Dec. 25, 2018

(54) SYSTEM AND METHODOLOGY USING ANNULUS ACCESS VALVE

(71) Applicant: Schlumberger Technology Corporation, Sugar Land, TX (US)

(72) Inventors: Nicholas Taylor, Rosharon, TX (US); Gregory Daniel, Pearland, TX (US); Boris Martinez, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/316,416

(22) PCT Filed: Jun. 8, 2015

(86) PCT No.: PCT/US2015/034622

§ 371 (c)(1),
(2) Date: Jan. 10, 2017

(87) PCT Pub. No.: WO2015/191417

PCT Pub. Date: Dec. 17, 2015

(65) Prior Publication Data

US 2017/0183956 A1 Jun. 29, 2017

Related U.S. Application Data

(60) Provisional application No. 62/009,712, filed on Jun. 9, 2014.

(51) Int. Cl.
*E21B 47/10* (2012.01)
*E21B 33/035* (2006.01)
(Continued)

(52) U.S. Cl.
CPC ..... *E21B 47/1025* (2013.01); *E21B 33/035* (2013.01); *E21B 33/043* (2013.01); *E21B 34/04* (2013.01); *E21B 33/064* (2013.01)

(58) Field of Classification Search
CPC .. E21B 47/1025; E21B 33/035; E21B 33/043; E21B 34/04; E21B 33/064
See application file for complete search history.

(56) References Cited

U.S. PATENT DOCUMENTS 4,202,410 A * 5/1980 Quebe ..... E21B 33/04 166/88.4
5,143,158 A * 9/1992 Watkins ..... E21B 33/043 166/344

(Continued)

OTHER PUBLICATIONS

PCT/US2015/034622 International Search Report and Written Opinion, dated Aug. 26, 2015, 9 pgs.

*Primary Examiner* — James G Sayre
(74) *Attorney, Agent, or Firm* — Brandon S. Clark

(57) ABSTRACT

A technique facilitates pressure testing of seals along a tubing hanger, such as a tubing hanger used in a subsea application. In some applications, the tubing hanger is sealed along its exterior with an upper tubing hanger seal and a lower tubing hanger seal. A valve assembly is deployed along a fluid passageway which is routed to the tubing hanger seals. The valve assembly may be selectively actuated to a test position, e.g. a closed position, which enables pressure isolation and pressure testing of the tubing hanger seals. The valve assembly may also be selectively utilized to introduce fluids into the formation below the tubing hanger.

20 Claims, 6 Drawing Sheets

(51) Int. Cl.

| | |
|---|---|
| ***E21B 34/04*** | (2006.01) |
| ***E21B 33/043*** | (2006.01) |
| *E21B 33/064* | (2006.01) |

(56) References Cited

U.S. PATENT DOCUMENTS

| | | | | |
|---|---|---|---|---|
| 5,544,707 | A * | 8/1996 | Hopper | E21B 33/03 166/368 |
| 6,062,314 | A | 5/2000 | Nobileau | |
| 6,644,411 | B2 * | 11/2003 | Compton | E21B 33/043 166/332.8 |
| RE44,520 | E * | 10/2013 | Hartmann | E21B 33/035 166/344 |
| 9,611,717 | B2 * | 4/2017 | Lockwood | E21B 34/02 |
| 2002/0121373 | A1 | 9/2002 | Patel | |
| 2009/0000781 | A1 | 1/2009 | Bolding | |
| 2010/0139910 | A1 | 6/2010 | Dyson et al. | |
| 2012/0205123 | A1 | 8/2012 | Kennedy | |

* cited by examiner

SYSTEM AND METHODOLOGY USING ANNULUS ACCESS VALVE

CROSS-REFERENCE TO RELATED APPLICATIONS

The present application is a 371 National Phase of International Patent Application No. PCT/US2015/034622 filed on Jun. 8, 2015, which is based on and claims priority to U.S. Provisional Application Ser. No. 62/009,712, filed Jun. 9, 2014, both applications incorporated herein by reference.

BACKGROUND

Hydrocarbon fluids such as oil and natural gas are obtained from a subterranean geologic formation, referred to as a reservoir, by drilling a wellbore that penetrates the hydrocarbon-bearing formation. Once a wellbore is drilled, various forms of well completion components may be installed to control and enhance efficiency of producing fluids from the reservoir. In various subsea applications, a vertical Christmas tree is installed at a subsea wellhead and combined with a tubing hanger. A seal is formed along an exterior of the tubing hanger via a plurality of seals, but difficulties sometimes arise with respect to adequately pressure testing the tubing hanger seals.

SUMMARY

In general, a methodology and system are provided which facilitate pressure testing of seals along a tubing hanger. In some applications, the tubing hanger is sealed along its exterior with an upper tubing hanger seal and a lower tubing hanger seal. A valve assembly is deployed along a fluid passageway which is routed to the tubing hanger seals. The valve assembly may be selectively actuated to a test position, e.g. a closed position, which enables pressure isolation and pressure testing of the tubing hanger seals. The valve assembly may also be selectively used to introduce fluids, such as acid, into the primary flow passage or annulus.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
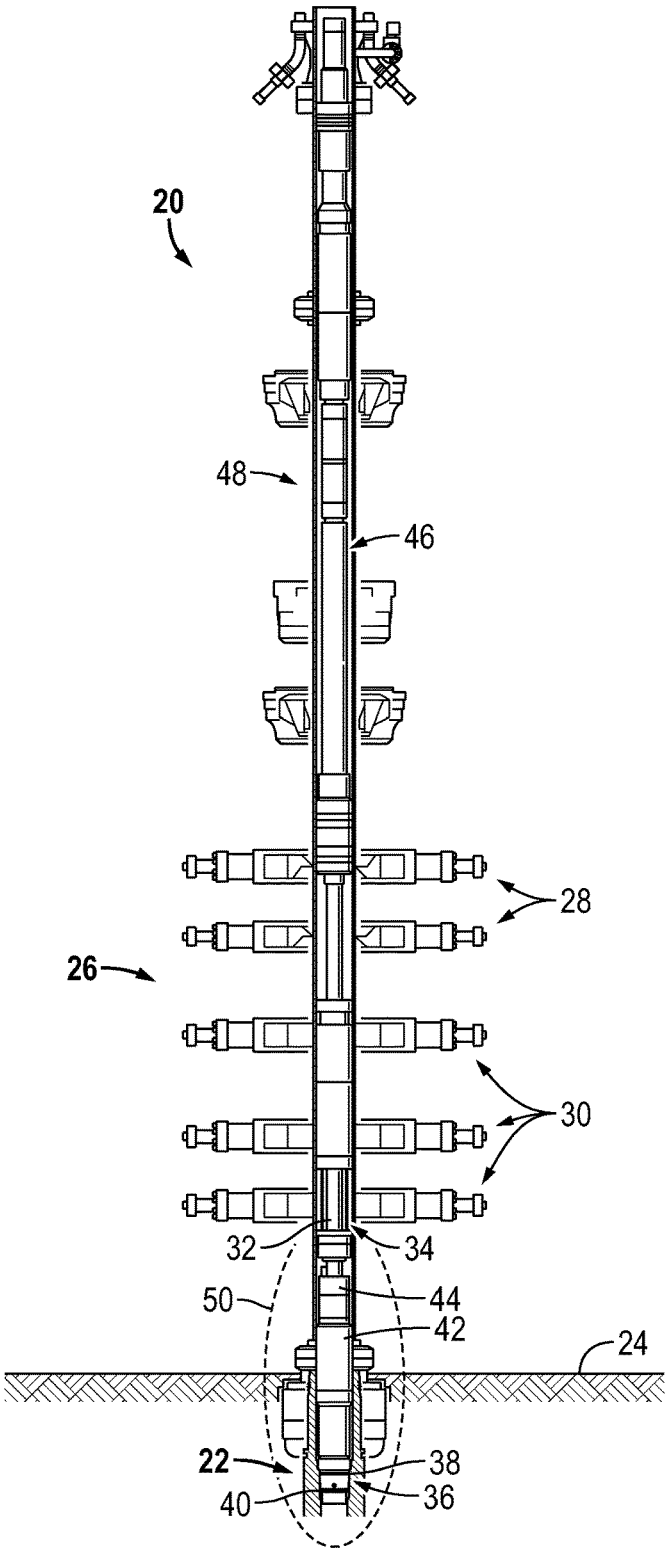
FIG. 1 is a schematic illustration of an example of a subsea well system utilizing a valve assembly which facilitates pressure testing of tubing hanger seals, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate pressure testing of a seal or seals along a tubing hanger. For example, the tubing hanger may be deployed through a subsea Christmas tree for sealing engagement with a subsea wellhead. In some applications, the tubing hanger is sealed along its exterior with an upper tubing hanger seal and a lower tubing hanger seal. A valve assembly is deployed along a fluid passageway which is routed to the tubing hanger seals. The valve assembly may be selectively actuated to a test position, e.g. a closed position, which enables pressure isolation and pressure testing of the tubing hanger seals. In some embodiments, the valve assembly may be located in an adapter hub and may be selectively actuated to open and close a fluid passageway used to pressure test an annular seal or seals.

According to an embodiment, the valve assembly may be constructed and located to enable pressure isolation of a portion of an annulus line in a subsea Christmas tree, e.g. a subsea vertical Christmas tree. The valve assembly and isolated section of annulus line allow tubing hanger seals to be pressure tested once the tubing hanger has been installed in, for example, a flow spool of the subsea Christmas tree. The valve assembly may be independently controlled via pressure applied from, for example, a surface control line or a subsea electro-hydraulic control system.

In various applications a purpose of the valve assembly is to isolate pressure between the annulus line of the vertical Christmas tree and a blowout preventer. The pressure is isolated to enable verification of sealing with respect to the hanger, e.g verifying sealing of upper and lower tubing hanger seals, once installed into the flow spool. The valve assembly isolates the seals so that a differential pressure may be tested across the annular seal or seals, e.g. upper and lower annular tubing hanger seals. The valve assembly prevents the pressure in the annulus line from normalizing to ambient (or annular) pressure. In some embodiments, the valve assembly also facilitates monitoring of the annulus line in real time during the seal verification process. The valve assembly also may be used to enable monitoring of the annulus line during various points of subsea well installation, flow back, and/or decompletion operation.

The valve assembly may be constructed to provide full bore access to the annulus line without restriction upon opening. Depending on the application, the valve may be constructed in a variety of suitable forms, including sliding sleeve type valves, ball valves, flapper valves, or other suitable types of valves. Generally, the valve assembly may be used in a number of suitable tree installations including horizontal and vertical tree installations to help enhance the efficiency of the offshore operation and to verify the integrity of not simply the lower tubing hanger seal but also the upper tubing hanger seal.

Referring generally to FIG. 1, an embodiment of a well system 20 is illustrated as comprising a subsea wellhead 22 disposed at a subsea surface 24, e.g. a seafloor. The well system 20 further comprises a subsea Christmas tree 26 mounted above wellhead 22. By way of example, the subsea Christmas tree 26 may comprise a plurality of shear rams 28 and pipe rams 30. The subsea Christmas tree 26 also may comprise a variety of other features, such as a ported slick joint 32 and choke and kill lines 34. Although the subsea Christmas tree 26 is illustrated as a vertical subsea Christmas tree, the Christmas tree 26 also may be in the form of a horizontal subsea Christmas tree in some applications.

Within subsea Christmas tree 26, a tubing hanger 36 is positioned for sealing engagement with wellhead 22 via suitable seals, such as an upper tubing string seal 38 and a lower tubing string seal 40 which provide sealing at the interface between the hanger 36 and wellhead 22. The tubing hanger 36 may be deployed into position through the subsea Christmas tree 26 via, for example, a tubing hanger running tool 42, associated tubing hanger running tool adapter 44, and a landing string 46. In the example illustrated, a blowout preventer (BOP) 48 is positioned above the subsea Christmas tree 26 and the landing string 46 extends through the BOP 48. As explained in greater detail below, the pressure integrity of the tubing hanger seals, e.g. upper and lower seals 38, 40, may be tested for both seals by employing a valve assembly in an annulus line to isolate pressure between the annulus line of the subsea Christmas tree 26 and the BOP 48

Figure 2:
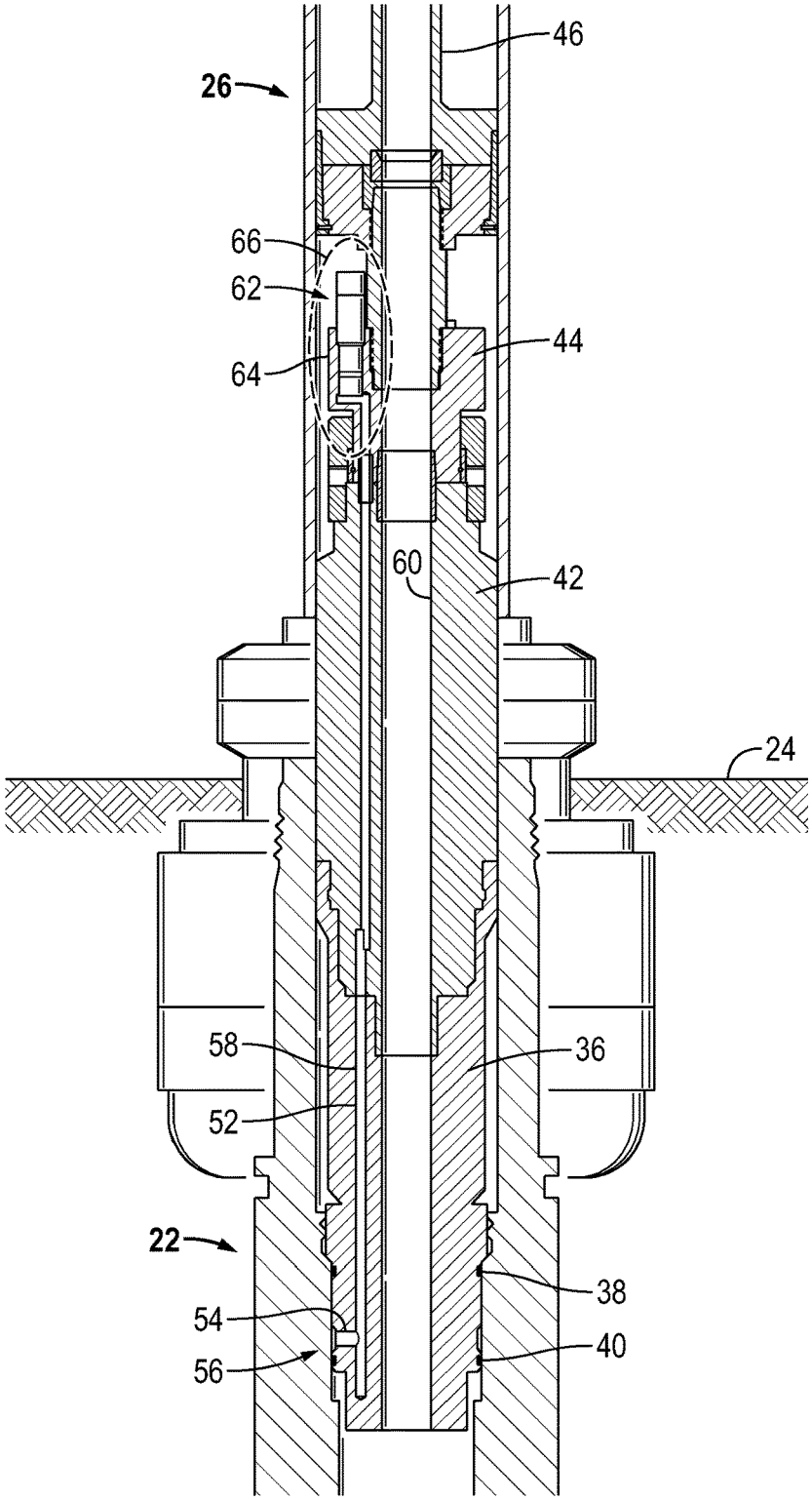
FIG. 2 is a cross-sectional view of a portion of the well system illustrated in FIG. 1, the portion showing a tubing hanger, tubing hanger seals, and an example of the valve assembly, according to an embodiment of the disclosure.

Referring generally to FIG. 2, a portion of the well system 20 encircled by dashed line 50 in FIG. 1 is illustrated in an enlarged view. As illustrated, a flow passage 52 extends to a tubing hanger port 54 located in a region 56 proximate upper and lower tubing hanger seals 38, 40 to enable pressure testing of both lower tubing hanger seal 40 and upper tubing hanger seal 38. By way of example, the port 54 and region 56 may be located between the upper tubing hanger seal 38 and the lower tubing hanger seal 40.

In various embodiments, the flow passage 52 may be defined by an annulus line 58 which may extend from BOP 48 and down through Christmas tree 26 and tubing hanger 36 to tubing hanger port 54. The annulus line 58 is located on the annulus side, e.g. radially outward, of a primary flow passage 60 which extends through tubing hanger 36 and along an interior of Christmas tree 26. The primary flow passage 60 may be used to facilitate passage of tools, treatment fluids, production fluids, and/or other fluids or devices.

A valve assembly 62 is positioned to enable selective control of access, e.g. flow, along the flow passage 52. For example, the valve assembly 62 may be positioned along the annulus line 58 at a suitable position. In the example illustrated, the valve assembly 62 is located in or adjacent tubing hanger adapter 44. For example, the valve assembly 62 may be located in an adapter hub 64 of tubing hanger adapter 44 or in another suitable hub. The valve assembly 62 is operable to selectively close off the flow passage 52/annulus line 58 during pressure testing of both the upper tubing hanger seal 38 and the lower tubing hanger seal 40.

By actuating valve assembly 62 to close off the annulus line 58, for example, pressure may be applied in flow passage 52 to create a desired pressure differential acting against the seals 38, 40. The pressure differential is applied at a desired level for a desired period of time to ensure the integrity of both lower tubing hanger seal 40 and upper tubing hanger seal 38. The valve assembly 62 effectively isolates pressure between the BOP 48 and the annulus line 58 associated with the Christmas tree 26 and tubing hanger 36. This enables the desired buildup of test pressure along the passage 52 between valve assembly 62 and seals 38, 40. The valve assembly 62 may also be utilized to introduce fluids through the choke and kill lines 34 into the primary flow passage 60 or into the annulus below the tubing hanger port 54, for example, in order to acid spot certain sections of the formation.

Figure 3:
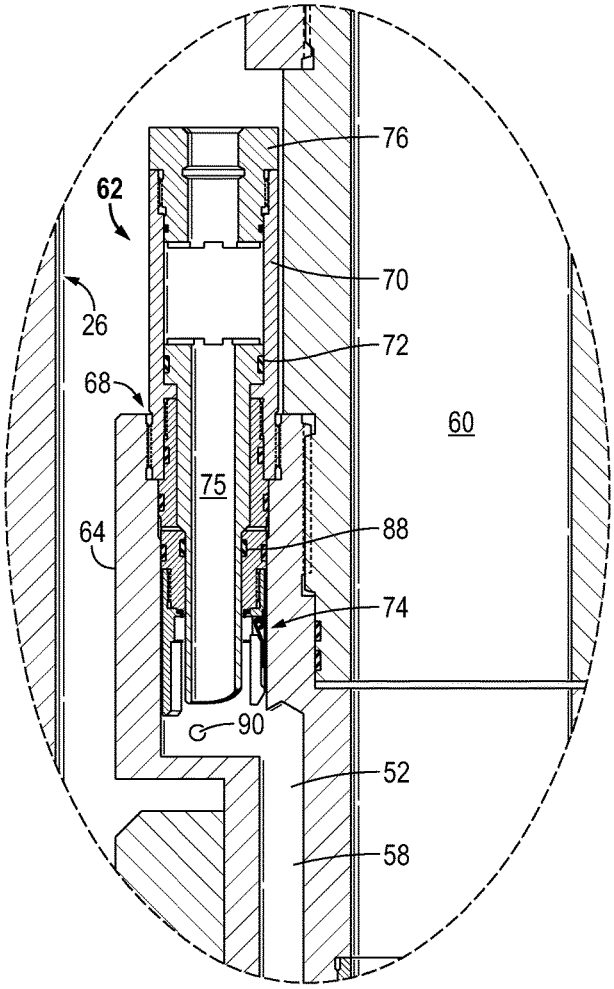
FIG. 3 is a cross-sectional view of an example of the valve assembly disposed along a fluid passageway, according to an embodiment of the disclosure.
Figure 4:
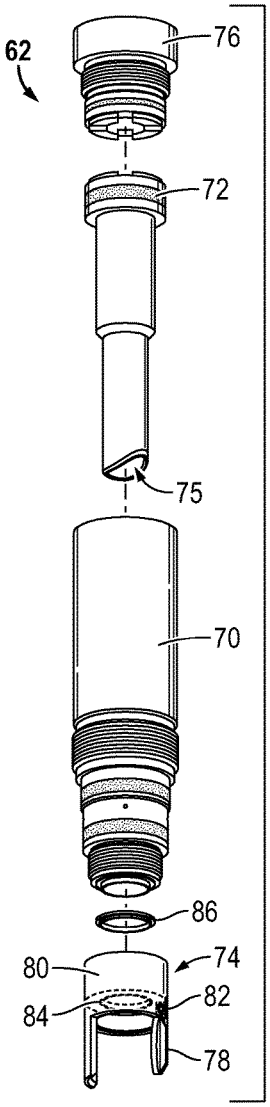
FIG. 4 is an expanded view of an example of the valve assembly, according to an embodiment of the disclosure.

Referring generally to FIG. 3, a portion of the adapter 44 encircled by dashed line 66 in FIG. 2 is illustrated in an enlarged view to show an embodiment of valve assembly 62. In this embodiment, valve assembly 62 is positioned along the annulus line 58 and mounted in a recess 68 of adapter hub 64. As further illustrated in the exploded view of FIG. 4, valve assembly 62 comprises a housing 70 which extends into and seals within recess 68. The housing 70 receives a piston 72 which may be selectively actuated, e.g. moved along the interior of housing 70, to open or close a valve 74. To accommodate flow along flow passage 52, piston 72 may have an internal flow passage 75. In the example illustrated in FIG. 3, piston 72 has been shifted downwardly to open valve 74 for flow through valve assembly 62 along flow passage 52. When piston 72 is shifted in an opposite direction against a piston stop 76, the valve 74 is transitioned to a closed position to enable elevation of pressure in the flow passage 52/annulus line 58 between valve assembly 62 and tubing hanger seals 38, 40.

Referring again to FIGS. 3 and 4, valve 74 may be in the form of a flapper valve having a flapper 78 pivotably mounted to a valve housing 80. In this embodiment, the flapper 78 is biased toward a closed position via a spring member 82. For example, spring member 82 may be in the form of a coil spring or band spring oriented to bias flapper 78 toward sealing engagement with a corresponding seat 84 of valve housing 80. However, valve 74 may comprise a variety of other types of valves actuatable by piston 72 or by another type of actuator mechanism. Examples of other valves 74 include sliding sleeve valves, ball valves, or other suitable valves.

In the example illustrated, the valve assembly housing 70 may be joined with valve housing 80 via a suitable seal 86. Additionally, the slidable piston 72 may be sealably engaged with an interior of valve assembly housing 70 via an annular seal 88. Seals such as seal 86 and annular seal 88 ensure sealing against pressure leaks when valve 74 is in a closed position. This enables pressure to be built up in the flow passage 52/annulus line 58 between valve 74 and the tubing hanger seals 38, 40.

By way of example, the increased pressure introduced into this portion of annulus line 58 so as to create a suitable pressure differential across seals 38, 40 may be introduced through a pressure test port 90. The pressure test port 90 also provides valve assembly 62 with the ability to facilitate monitoring of the annulus line 58 in real time during the seal verification process. Various sensors also may be communicatively coupled with pressure test port 90 to enable monitoring of pressure in the annulus line 58 during various other operations, such as subsea well installation operations, flow back operations, and/or decompletion operations. In the illustrated embodiment, valve 74 and valve assembly 62 are constructed to enable full bore access through the annulus line 58 without restriction.

Figure 5:
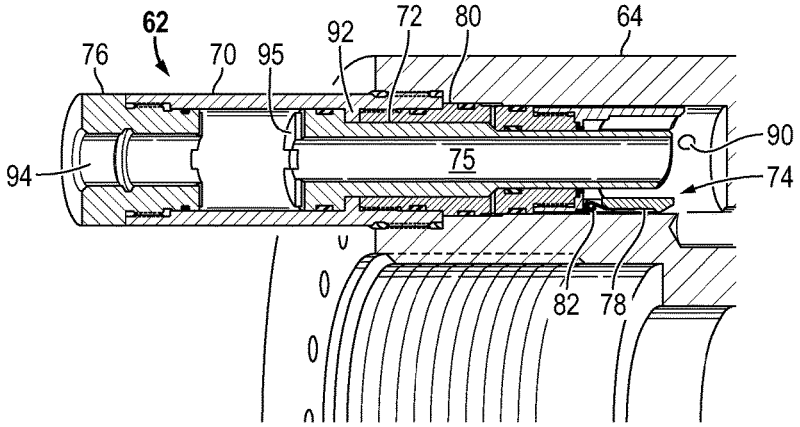
FIG. 5 is a cross-sectional view of an example of the valve assembly in an open flow position with respect to flow along the fluid passageway, according to an embodiment of the disclosure.

Referring generally to FIGS. 5-8, various cross-sectional views are provided of an embodiment of the valve assembly 62 positioned in adapter hub 64. In this example, the adapter hub 64 comprises recess 68 located at an annularly offset position relative to primary flow passage 60. The valve assembly piston 72 may be selectively actuated to an open flow position, as illustrated in FIG. 5, by shifting the piston 72 against and through valve 74 to displace flapper 78. When shifting to this open flow position, the travel of piston 72 is limited by a travel stop 92.

Figure 6:
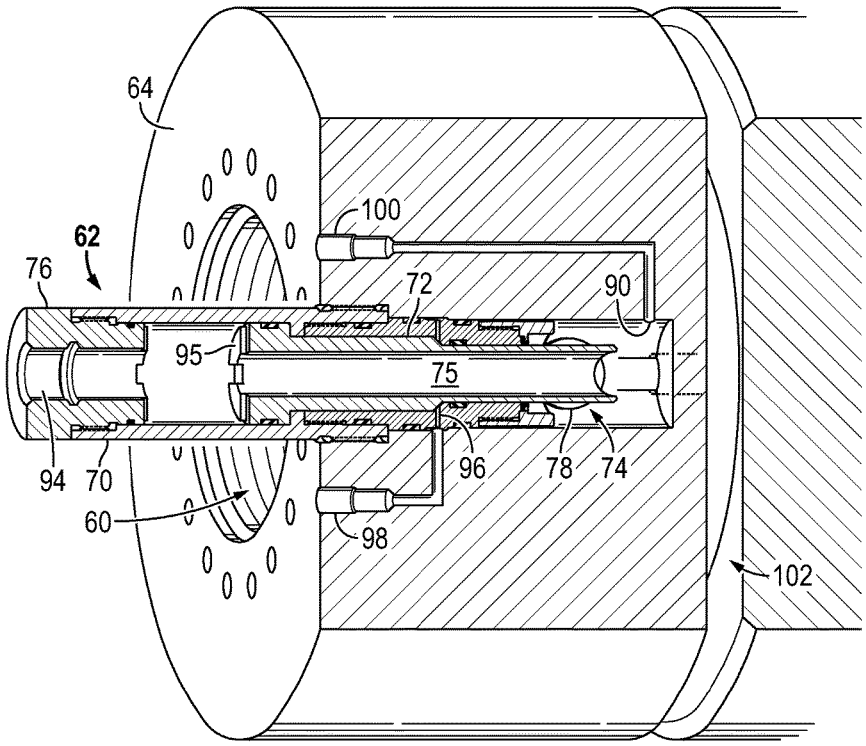
FIG. 6 is a cross-sectional view of an example of the valve assembly positioned in an adapter hub of the well system, according to an embodiment of the disclosure.

The piston 72 may be shifted to the illustrated open flow position by applying fluid under sufficient pressure through an opening 94 in piston stop 76. The pressurized fluid flowing through opening 94 acts against piston head 95 of piston 72 and shifts piston 72 until valve 74 is transitioned to the open flow position. Piston 72 may be shifted in an opposite direction to enable closure of valve 74 by applying fluid pressure against piston 72 in an opposite direction via port 96, as illustrated in FIG. 6. Pressurized fluid may be selectively delivered through port 96 via a corresponding passageway 98 formed through adapter hub 64.

Figure 7:
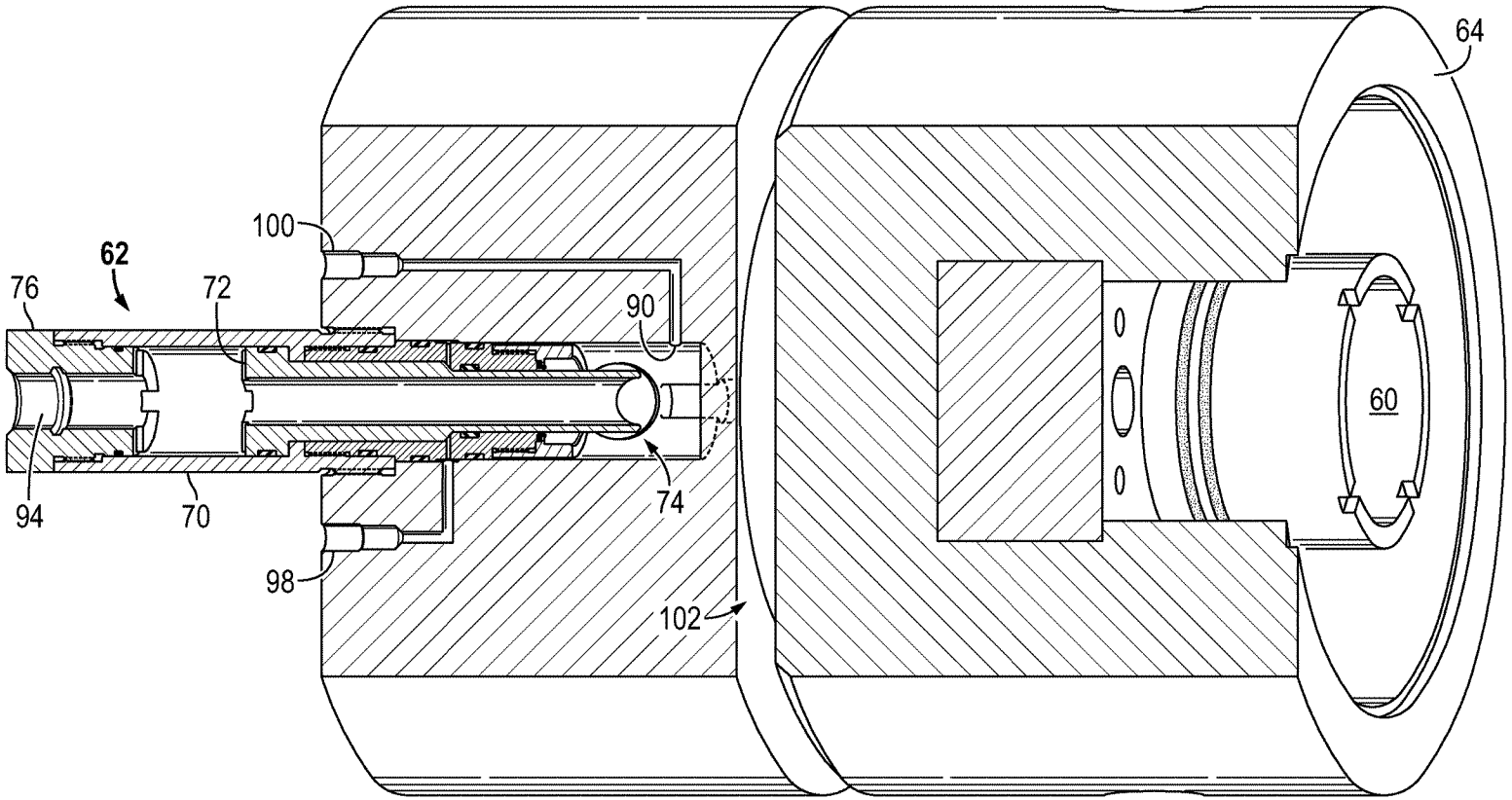
FIG. 7 is another cross-sectional view of an example of the valve assembly positioned in the adapter hub of the well system, according to an embodiment of the disclosure.
Figure 8:
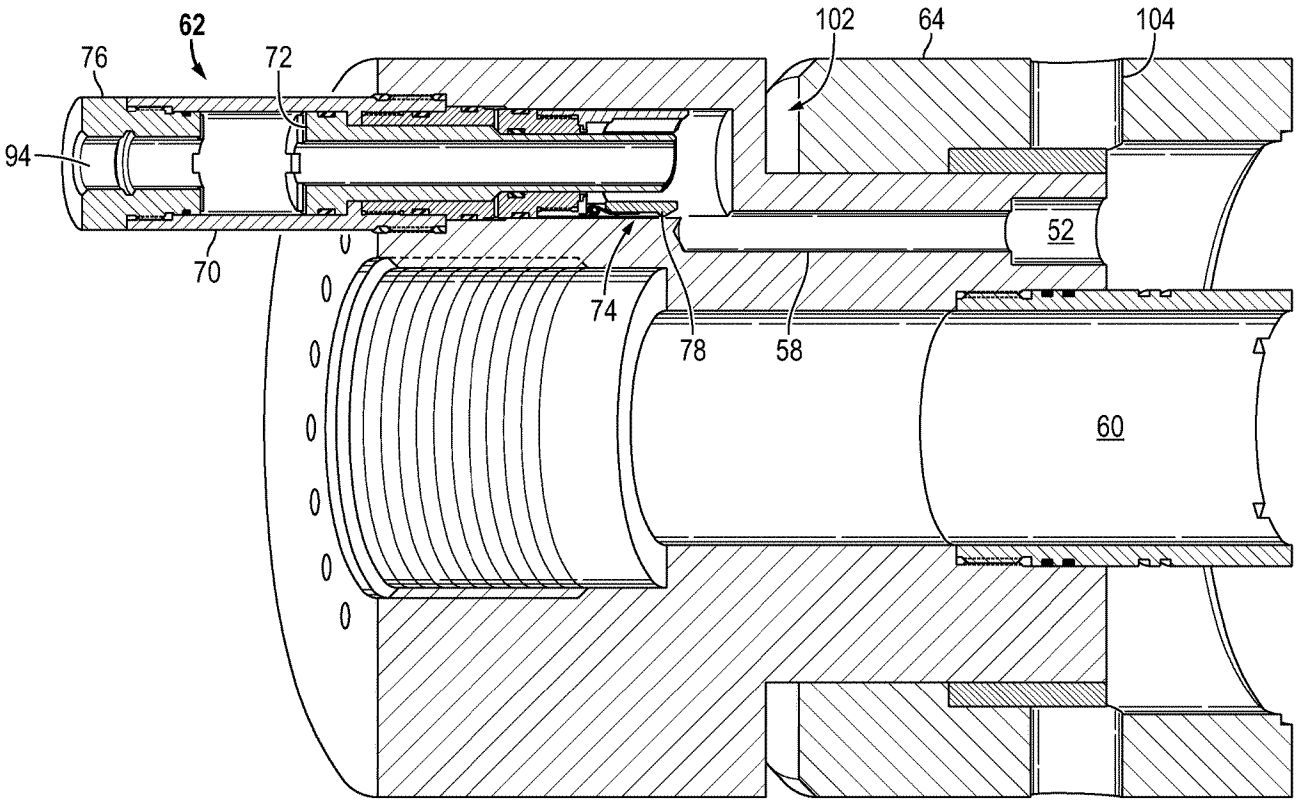
FIG. 8 is another cross-sectional view of an example of the valve assembly positioned in the adapter hub of the well system, according to an embodiment of the disclosure.

As illustrated in FIGS. 6-8, pressurized fluid may be delivered into flow passage 52/annulus line 58 via pressure test port 90 for pressure testing of both upper tubing hanger seal 38 and the lower tubing hanger seal 40. Once piston 72 is shifted against stop 94 via pressurized fluid supplied through port 96 and passage 98, valve 74 is transitioned to a closed position, e.g. spring biased to the closed position. Closure of valve 74 enables buildup of pressure in the annulus line 58 between valve assembly 62 and tubing hanger seals 38, 40. (See portion of annulus line 58 in communication with pressure test port 90 in FIG. 3.) The pressurized fluid may be delivered through pressure test port 90 via, for example, a pressure test passage 100 formed in adapter hub 64. This pressure test passage 100 also may be connected to a variety of other sensors for monitoring pressure within annulus line 58 during numerous types of operational procedures. The valve 74 may be selectively reopened by, for example, providing pressurized fluid flow through opening 94. In some applications, the fluid flow to reopen valve 74 may be delivered to opening 94 via a choke line on the BOP 48 and subsea Christmas tree 26.

Depending on the application, the adapter hub 64 may comprise a variety of other features. By way of example, the adapter hub 64 may comprise an annular seal slot 102 to accommodate an annular seal able to provide a pressure seal between the adapter hub 64 and the surrounding portion of subsea Christmas tree 26. By way of further example, the adapter hub 64 may be provided with an annular access opening 104 to selectively enable flow between an exterior and interior of the adapter hub 64. Various other features and components may be combined with adapter hub 64 to accommodate the parameters of a given application.

Similarly, the valve assembly 62 may comprise a variety of other and/or additional components and features. For example, various configurations of housings, actuators, e.g. pistons, valves, seals, stops, ports, passages, and/or other components and features may be incorporated into the structure to accommodate the specifics of a given application. Additionally, the valve assembly 62 may be used with many types of tubing hanger assemblies, Christmas trees, blowout preventers, landing strings, and/or other well system equipment. The function of valve assembly 62 also may be accomplished by a variety of structures which enable pressure isolation of both lower and upper tubing hanger seals for pressure testing and seal integrity verification.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for seal testing in a well, the method comprising:

installing a tubing hanger in a subsea Christmas tree at the well;

externally sealing the tubing hangar at a wellhead defining the well with an upper tubing hanger seal between the hangar and the wellhead and a lower tubing hanger seal between the hangar and the wellhead;

routing an annulus line through a blowout preventer and the subsea Christmas tree to a location that is both between the seals and between the hangar and the wellhead to enable application of test pressure to both the upper tubing hanger seal and the lower tubing hanger seal simultaneously via a flow passage provided by the annulus line; and using a valve located in an adapter hub and in fluid communication with the annulus line to selectively close off the annulus line during pressure testing of both the upper tubing hanger seal and the lower tubing hanger seal.

2. The method as recited in claim 1, further comprising applying test pressure to the annulus line via a pressure test port while the valve is in a closed position.

3. The method as recited in claim 2, further comprising shifting the valve to an open position via pressure applied in the annulus line on an opposite side of the valve relative to the upper tubing hanger seal.

4. The method as recited in claim 1, further comprising applying test pressure to the annulus line via a pressure test port while the valve is closed to simultaneously pressure test the upper tubing hanger seal and the lower tubing hanger seal by establishing a differential pressure across both the upper tubing hanger seal and the lower tubing hanger seal.

5. The method as recited in claim 1, further comprising forming the valve as a flapper valve.

6. The method as recited in claim 5, further comprising shifting the flapper valve to an open position via a piston.

7. The method as recited in claim 1, further comprising routing the annulus line to a region between the upper tubing hanger seal and the lower tubing hanger seal.

8. The method as recited in claim 1, further comprising locating the annulus line in a radially offset position relative to a primary flow passage through the Christmas tree.

9. The method as recited in claim 1, further comprising providing the valve with capability for full bore flow along the annulus line.

10. A system, comprising:

a subsea wellhead; and a subsea Christmas tree mounted on the subsea wellhead, the subsea Christmas tree comprising:

a tubing hanger forming seals with the wellhead at an interface therewith via an upper tubing hanger seal and a lower tubing hanger seal between the hanger and the wellhead; and a valve assembly located in an adapter hub and in fluid communication with a flow passage positioned externally of a primary flow passage through the Christmas tree, the flow passage providing communication between a pressure test port at the interface and between the upper and lower tubing hanger seals, the valve assembly having a valve selectively shiftable from an open flow position to a closed flow position such that a pressure differential may be established across both the upper and lower tubing hanger seals via the pressure test port when the valve is in the closed position.

11. The system as recited in claim 10, wherein the valve comprises a flapper valve.

12. The system as recited in claim 10, further comprising a blowout preventer mounted above the Christmas tree.

13. The system as recited in claim 12, wherein the flow passage extends to the blowout preventer and the valve assembly is selectively actuatable to isolate pressure in the flow passage between the blowout preventer and the upper and lower tubing hanger seals.

14. A method, comprising:

establishing a seal about a tubing hanger via an upper tubing hanger seal at an interface between the hanger and a wellhead and a lower tubing hanger seal at the interface;

selectively isolating a flow passage defined by an annulus line extending from a blowout preventer through a Christmas tree and into the tubing hanger to a location between the upper tubing hanger seal and the lower tubing hanger seal; and testing seal integrity at the upper tubing hangar seal and the lower tubing hangar seal simultaneously by establishing a pressure differential across the upper tubing hangar seal and the lower tubing hangar seal via the flow passage while the flow passage is selectively isolated.

15. The method as recited in claim 14, wherein selectively isolating comprises selectively actuating a valve assembly disposed along the flow passage.

16. The method as recited in claim 15, further comprising positioning the tubing hanger by moving the tubing hanger through the subsea Christmas tree.

17. The method as recited in claim 16, further comprising routing the flow passage along an annular line located externally of a primary flow passage through the Christmas tree.

18. The method as recited in claim 15, wherein actuating the valve assembly comprises actuating a flapper valve.

19. The method as recited in claim 15, wherein testing comprises applying a test pressure via a pressure test port when the valve assembly is in a closed position.

20. The method as recited in claim 19, wherein testing comprises establishing the pressure differential at a specific level for a specific time period.

* * * * *